US006834168B2

(12) United States Patent
Kondo

(10) Patent No.: US 6,834,168 B2
(45) Date of Patent: Dec. 21, 2004

(54) IMAGE FIXING DEVICE HAVING TEMPERATURE DETECTION INTERVAL CHANGING DEVICE

(75) Inventor: Shunsaku Kondo, Toride (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 10/395,177

(22) Filed: Mar. 25, 2003

(65) Prior Publication Data

US 2003/0219270 A1 Nov. 27, 2003

(30) Foreign Application Priority Data

Mar. 25, 2002 (JP) ..... 2002-082195

(51) Int. Cl.[7] ..... G03G 15/00
(52) U.S. Cl. ..... 399/45; 399/69
(58) Field of Search ..... 399/45, 69, 70, 399/328, 335; 219/216, 667, 494; 432/60; 374/153

(56) References Cited

U.S. PATENT DOCUMENTS 4,439,143 A * 3/1984 Hanamoto et al. ..... 432/36
5,832,354 A * 11/1998 Kouno et al. ..... 399/330
5,966,562 A * 10/1999 Maehara ..... 399/69
6,087,641 A * 7/2000 Kinouchi et al. ..... 219/619
6,246,843 B1 * 6/2001 Nanataki et al. ..... 399/45
6,393,232 B1 5/2002 Osari et al. ..... 399/82
6,421,523 B1 7/2002 Kondo et al. ..... 399/404

FOREIGN PATENT DOCUMENTS

JP 59085516 A * 5/1984 ..... G05D/23/20
JP 09185276 A * 7/1997 ..... G03G/15/20
JP 2001056621 A * 2/2001 ..... G03G/15/20

* cited by examiner

*Primary Examiner*—Robert Beatty
(74) *Attorney, Agent, or Firm*—Fitzpatrick, Cella, Harper & Scinto

(57) ABSTRACT

A fixing apparatus includes a fixing member for fixing on a recording material an image formed on a recording material by heat; a temperature sensor for sensing a temperature of the fixing member; detection interval changing device for changing an interval of detecting operation of the temperature sensor, wherein the detection interval changing device changes the interval in accordance with a thickness of the recording material.

9 Claims, 3 Drawing Sheets

| | PLAIN P | THIN P | THICK P | OHP |
|---|---|---|---|---|
| MONO | STNDRD | STNDRD×2.0 | STNDRD×0.5 | STNDRD×0.25 |
| CLR | STNDRD×0.5 | STNDRD | STNDRD×0.25 | STNDRD×0.125 |

IMAGE FIXING DEVICE HAVING TEMPERATURE DETECTION INTERVAL CHANGING DEVICE

FIELD OF THE INVENTION AND RELATED ART

The present invention relates to fixing device for image fixing in an electrophotographic apparatus or the like.

More particularly, the present invention relates to a fixing device for an image forming apparatus of an electrophotographic type, wherein a transfer material on which toner is carried electrostatically and which toner comprises resin material, magnetic material, coloring material and the like, is passed through a nip. The nip is formed by heating means (roller, endless belt member or the like) and pressing means (roller, endless belt member or the like) which are press-contacted with each other and rotated, wherein the toner is subjected to heat and pressure during the passage of the transfer material through the nip to fuse and fix the toner on the transfer material.

In a conventional image forming apparatus, a toner image if formed by an image forming station, and the toner image is transferred onto a recording material such as a transfer sheet, recording sheet, photosensitive paper, electrostatic recording paper or the like, and thereafter, the toner image is fixed on a recording material into a permanent image by a heat fixing device of a heating roller type. Such a heating roller type apparatus comprises a fixing roller (fixing member) including a heater therein and a pressing roller press-contacted thereto to form a nip therebetween. The recording material is passed through the nip, by which the unfixed toner image formed and carried on the surface of the recording material is fixed on the surface of the recording material by the heat and pressure applied by the nip. For the heater, a halogen heater is used, wherein a radiant heat from the halogen heater is used, and therefore, the heat loss in the heat transfer from the halogen heater to the fixing roller is relatively large. In addition, since the fixing roller is heated indirectly from the halogen heater, the start-up time is relatively long. An IH type (electromagnetic induction heating type) heater is known with which energy consumption is reduced, and the start-up time is short. In the electromagnetic induction heating type, a high frequency current is applied to an excitation coil, and the high frequency magnetic field generated by the excitation coil is applied on the inner surface surface layer of the heat roller to generate eddy currents in the electroconductive layer of the fixing roller. By the eddy currents, self-heat-generation occurs in the heat roller due to the joule heat. Using such a heating method, the inner surface surface layer of the heat roller is the heat generating element, and therefore, a direct heating is effected. For this reason, the heat generating efficiency is high, and the heat roller can be quickly heated lip to a fixing temperature without difficulty. This accomplishes quick start-up. Also, since the efficiency is high, the electric energy consumption can be significantly reduced.

In order to properly fix the unfixed toner image on the recording material by heat in the fixing in device, a temperature control is effected to maintain a predetermined temperature of the fixing roller. As a temperature control system, it is considered that temperature of the fixing roller is detected by a temperature sensor, and in accordance with the result of the detection, the electric power supplied to the heater is linearly controlled (feed-back type). Referring first to FIG. 4, the description will be made as to the relation between the temperature and the electric power supplied to the induction coil corresponding to the temperature in the induction heating type apparatus. In FIG. 4, the ordinate represents an electric power value Po supplied to the heat source, and the abscissa represents the temperature T, that is, when the temperature of the fixing roller is Ta, the induction coil is supplied with the electric power Pa. By changing the supplied electric power to the induction coil in accordance with the temperature of the fixing roller, the temperature of the fixing roller can be maintained at the predetermined set temperature. Here, the temperature sensor for detecting the temperature of the fixing roller detects the temperature of the fixing roller at predetermined clearances (cyclic period of detection). Therefore, the temperature of the fixing roller is controlled to be constantly at the set temperature by determining the electric power supplied to the induction coil in accordance with the temperature detected at the sampling intervals. During the fixing operation, however, the amount of the toner carried on the transfer sheet is not constant, and more particularly, the amount is larger when the toner image on the transfer material is a color image than when it is a monochromatic image. Therefore, when the image is a color image, the heat quantity required to fix the image on the recording material is large, so that heat quantity removed from the fixing member is large. Then, the lowering degree of temperature in one detection interval or period of temperature detection of the temperature sensor is larger. As a result, the controlled temperature of the fixing member involves a larger ripple, so that non-uniformity in the glossiness may result in the fixed images. It is preferable that decrease of the temperature in one interval of temperature detection in the fixing operation is reduced by shortening the detection interval. In addition, the heat quantity required to fix the image is different depending on the kinds of the transfer sheets. For example, where the thickness of the recording material is large, the heat quantity removed from the fixing member during the fixing operation is large, and therefore, the lowering degree of the temperature in one interval is large. As a result, the ripple of the temperature of the fixing member is large with the result of non-uniformity in the glossiness in the image after the fixing. On the other hand, when the toner image is fixed on a thin recording material, the lowering degree of the temperature of the fixing member is relatively small as compared with the case of the thick recording material. Therefore, when the detection intervals are the same as with the thick recording material case, the electric power is supplied even when the temperature decrease is small, with the result of large ripple of the temperature of the fixing member. This may result in a non-uniformity in the glossiness of the fixed images.

SUMMARY OF THE INVENTION

Accordingly, it is a principal object of the present invention to provide a fixing apparatus or method wherein a temperature variation of the fixing member is minimized irrespective of fixing condition.

It is another object of the present invention to provide a fixing apparatus comprising a fixing member for fixing on a recording material an image formed on a recording material by heat; a temperature senior for sensing a temperature of said fixing member; detection interval changing means for changing an interval of detecting operation of said temperature sensor, wherein said detection interval changing means changes the interval in accordance with a thickness of the recording material.

These and other objects, features and advantages of the present invention will become more apparent upon a consideration of the following description of the preferred embodiments of the present invention taken in conjunction with the accompanying drawings.

DESCRIPTION OF THE PREFERRED EMBODIMENT

A first embodiment of the present invention will be described.

(1) Example of an Image Forming Apparatus

Figure 1:
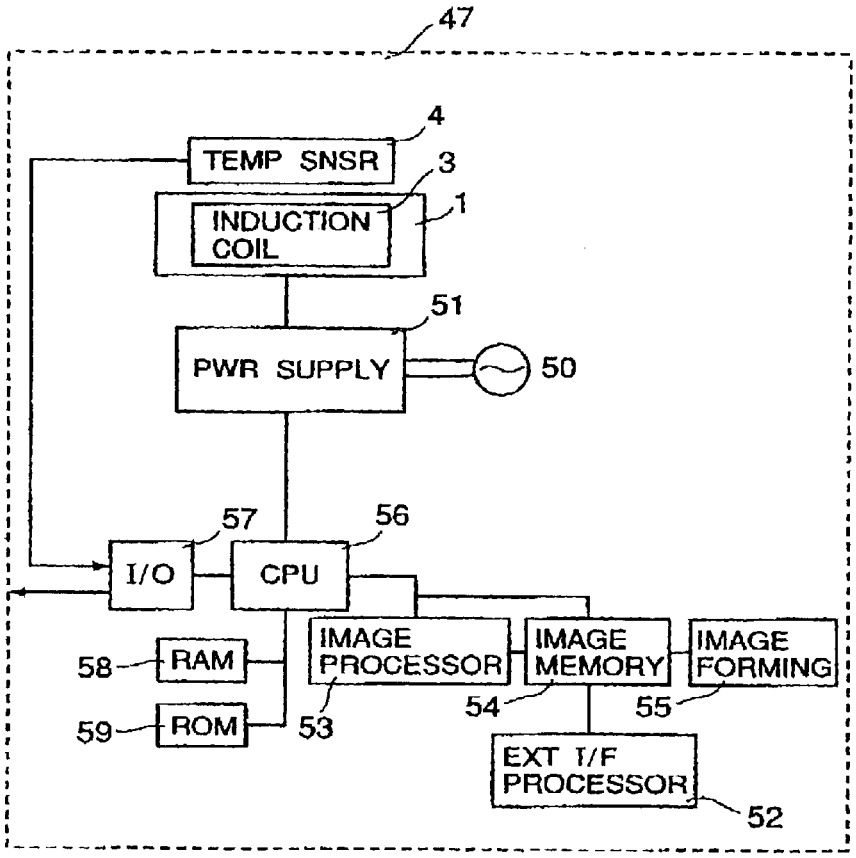
FIG. 1 is a block diagram of a laser beam printer according to an embodiment of the present invention.

FIG. 1 is a block diagram of a basic structure of an image forming apparatus according to the first embodiment of the present invention. The image forming apparatus is, for example, a laser beam printer 47. The printer 47 includes a central information processing CPU 56 for effecting a basic control to which which are connected through an address bus and a data bus line a semiconductor memory device ROM 59 storing control programs, a work RAM 58 for effecting various processing, and I/O port 57. The I/O port 57 is connected with various loads (unshown) such as a motor, clutch or the like which controls the printer 47 and with inputting devices such as sensor 4 for detecting the temperature of the fixing roller. The CPU 56 effects a sequential input/output control through the I/O port 57 under the control of the program in the ROM 59 to properly carry out the printing operation. Furthermore, the CPU 56 is connected with an image processor 53 an image memory portion 54 for storing the processed image, and an electric power supply portion 51 for applying a high frequency current to an induction coil portion 3 for induction healing of the fixing roller portion 1. The image memory portion 54 is connected with an image forming station 55 for forming an unfixed image on the recording material and an external I/F processing portion 52. The external I/P portion 52 converts the PDL (page-description language) inputted from an outside computer into bit map data.

Figure 2:
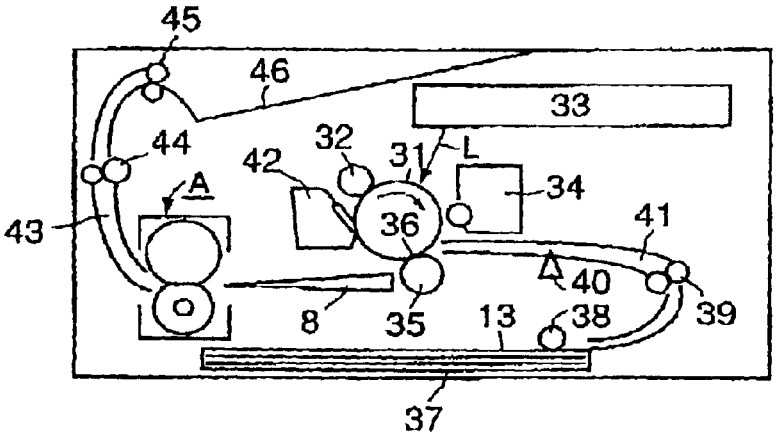
FIG. 2 is a schematic illustration of a laser beam printer according to an embodiment of the present invention.

FIG. 2 is a schematic illustration of the image forming apparatus according to this embodiment of the present invention. In this embodiment, the image forming apparatus is a laser beam printer using an image transfer type electrophotographic process and using an induction heating type fixing device. Designated by 31 is an electrophotographic photosensitive member (photosensitive drum) which functions as an image bearing member, and is rotated in the clockwise direction indicated by an arrow at a predetermined peripheral speed (process speed). The photosensitive drum 31, while it is rotated, is electrically charged by a charging roller 32 (charging device) to a uniform potential of a predetermined polarity.

The photosensitive drum 31 is then exposed to a scanning laser beam which is supplied from a laser scanner 33 and which is modulated in accordance with an intended image information pattern. By this, an intended electrostatic latent image is formed on the surface of the photosensitive drum 31 correspondingly to the intended image information pattern. The electrostatic latent image formed on the surface of the photosensitive drum 31 is developed into an unfixed toner image by a developing device 34. The developing method may be a jumping developing method, two component developing method or the like and is often a combination of image exposure and reverse development. The toner image formed on the surface of the photosensitive drum 31 is sequentially transferred by electrostatic force onto a recording material (transfer material) 13 which is fed at a predetermined timing from a sheet feeder 37 into a transfer nip 36 formed by the photosensitive drum 31 and the transfer roller 35. In the image forming apparatus of this example, the sheet feeder 37 is in the form of a cassette sheet feeder, and recording material 13 stacked and accommodated in the sheet feeding cassette is fed out one by one by the cooperation of the sheet feeding roller 38 and an unshown separating member. The singled out recording material is fed into the transfer nip 36 at predetermined controlled timing through an image forming apparatus including a pair of feeding rollers, a top senior (registration sensor) 40 or the like. The leading edge of the recording material 13 to the transfer nip 36 from the cassette sheet feeder 37 is sensed by a top sensor 40 provided in the sheet path 41, and in synchronism with the sensing, an image is formed on the photosensitive drum 31.

The recording material 13 having received the unfixed toner image in the transfer nip 36 is gradually separated from the surface of the photosensitive drum 31, and then is introduced into the fixing device A through the feeding guide 8. The fixing device A functions to fix the unfixed toner image on the recording material by heat. The recording material 13 now having the fixed image is discharged onto a sheet discharge tray portion 46 by a pair of discharging roller through a sheet discharging path 43 including a pair of feeding rollers 44. On the other hand, after the toner image transfer operation, the deposited contamination such as untransferred toner, paper dust or the like remaining on the surface of the photosensitive drum 31 is removed by a cleaner 42 (cleaning means). The cleaned photosensitive drum 31 is subjected to a repealed image formation.

(2) Fixing Device A

Figure 3:
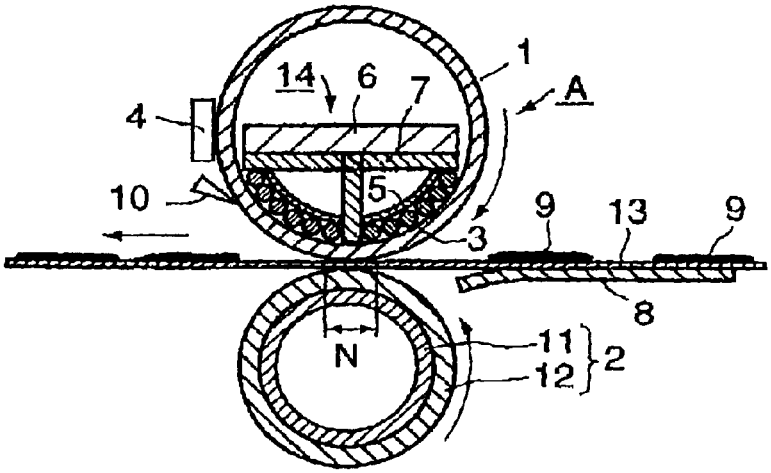
FIG. 3 is a cross-sectional view of a major part of a fixing device An according to an embodiment of the present invention.
Figure 4:
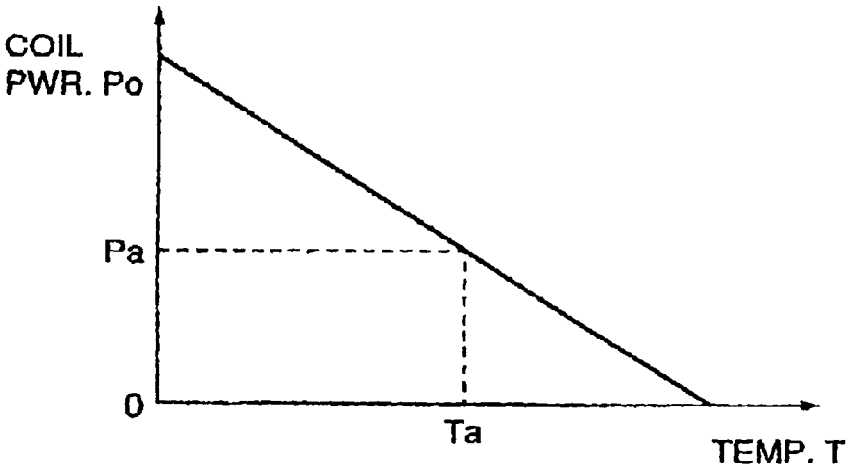
FIG. 4 is a graph showing a relation between the temperature and the electric power supply in a conventional temperature control system.

FIG. 3 is a schematic cross-sectional view of a major part of the fixing device A. Designated by reference numeral 1 is a fixing roller (heating roller) (fixing member), and numeral 2 is a pressing roller (pressing member). The fixing roller 1 is made of an electroconductive material which generates heat by induced current, and in this embodiment, it comprises a core metal cylinder (electroconductive cylindrical roller) of steel having an outer diameter of 40 mm and a thickness of 0.7 mm and a surface parting layer of PTFE or PFA or the like having a thickness of 10–50 $\mu$m for enhancing a surface parting property. In order to reduce non-uniformity in the temperature of the surface of the roller or to enhance the fixing property, a silicone rubber layer (elastic layer) having a thickness of 20–500 $\mu$m may be provided between the core metal cylinder and the surface parting layer.

The pressing roller 2 comprises a hollow core metal 11 and a surface parting layer of heat resistive rubber on the outer surface of the hollow core metal 11, or a sponge layer (elastic layer 12) for heat insulation between the hollow core metal 11 and the surface. The fixing roller 1 and the pressing roller 2 are disposed in parallel with each other such that fixing roller 1 and the pressing roller 2 take upper side and lower side positions, respectively. The opposite ends thereof are rotatably supported by hearing portions between fixing unit frames. The pressing roller 2 is urged upward by an unshown pressing mechanism including a spring or the like to press against the lower surface portion of the fixing roller 1 with a predetermined pressure to form a fixing nip N. In this example, the pressing roller 2 is urged with approx. 30 kgf which leads to a width of the nip N of approx. 6 mm. The weight may be different to change the nip width.

In this example, the fixing roller 1 is rotated by an unshown driving mechanism, and the pressing roller 2 is rotated by the frictional force from contact with fixing roller 1 at the fixing nip N. Designated by numeral 14 is an induction coil assembly disposed in the inner space of the fixing roller 1 and comprises an induction coil 3 (coil), a coil holder 5 for supporting the coil, a core (core of the magnet) 7, and stay 6. The coil holder 5 is a trough-like member having a substantially semicircular cross-section and made of a heat resistive resin material such as PPS, PEEK, and phenol resin material, and lead wire is wound around the coil holder 5 to constitute an induction coil 3. Core 7 has a T-shaped cross-section and is disposed in the coil holder 5. It is made integral into an induction coil assembly. The induction coil assembly 14 is inserted into the inside space of the fixing roller 1. At this time, the induction coil 3 outside the coil holder 5 is faced down, and is made close to the inner surface of the fixing roller 1. The opposite ends of the stay 6 are fixed on a fixing unit frames (unshown) so that induction coil assembly 14 is positioned in the inner space of the fixing roller 1. Designated by 4 is a temperature sensor such as a contact type thermistor (temperature sensor) disposed contacted to the surface of the fixing roller 1, an infrared radiation formula non-contact thermistor or the like. Designated by 10 is a separation claw which is contacted to or close to the surface of the fixing roller 1 at the recording material outlet of the fixing nip N.

When the fixing roller 1 is rotated, and the pressing roller 2 is rotated by the fixing roller 1, the induction coil 3 is supplied with a high frequency AC current from the electric power supply portion 51 shown in FIG. 1. The voltage supply portion is capable of generating a high frequency of 10 kHz-100 kHz by a switching voltage source. The induction coil 3 generates alternating magnetic flux by the high frequency AC current supplied from the voltage supply portion. The magnetic field induced by the AC current generates eddy currents in the inside surface of the fixing roller 1 which is an electroconductive layer, thus producing joule heat, by which the fixing roller 1 is efficiently and speedily heated.

The temperature of the fixing roller 1 is detected by the temperature sensor 4 at predetermined sample intervals, and the detected temperature signal is fed into the CPU 56 through the I/O port 57. The CPU 56 increases or decreases at proper timing the electric power supply to the induction coil 3 from the voltage supply portion 51 on the basis of the detected temperature signal so as to maintain the surface temperature of the fixing roller 1 at a predetermined constant temperature (target temperature). With the surface temperature of the fixing roller 1 automatically controlled at a predetermined constant temperature, a recording material 13 is fed into the fixing nip N and is nipped and fed thereby, so that unfixed toner image 9 is heated and fixed on the surface of the recording material 13 by the heat of the fixing roller 1. In order to increase the heat generation of the fixing roller 1, the number of windings of the induction coil 3 is increased; the core 7 is made of a high magnetic permeability and low remanent magnetic flux density material such as ferrite or permalloy; or the frequency of the AC current may be raised. In this example, the induction coil 3 has 6 turns of winding of litz wire comprising 50–150 wires. The number of winding is not limited to 6, but may be 4–10 turns.

(3) Temperature Control

Referring to a flow chart of FIG. 5, the description will be made as to the temperature control operation of the fixing device A when the laser beam printer 47 is in operation.

First, the discrimination is made as to whether or not the print condition has been changed from the previous one (S01). If so, the operation branches to yes-side at step S01, wherein the sampling period or interval for the temperature control is determined (S02). The sample cyclic period is discriminated on the basis of a Table in FIG. 6. In this embodiment, the standard value of the sampling period is set at 100 msec. The relation of the thicknesses of the plain paper, the thin paper, the thickness paper, the OHP sheet (transparent resin sheet) are such that thin paper<plain paper<thick paper<OHP. For the monochromatic image formation on a thin paper, the period is standard value×2.0, namely, 200 msec. On the other hand, for the case of a monochromatic image formation on a thick sheet, the sampling period is set at standard value×0.25, namely, 50 msec. As will be understood from the Table, the sampling period is shortened with increase of the thickness, and is made longer with decrease of the thickness. As the monochromatic image and the full-color image are compared with each other, it is understood that thickness of the toner layer formed on the recording material is larger in the case of full-color image, and therefore, the heat is easily removed from the fixing member than in the case of monochromatic image. For this reason, the sampling period is set shorter for the full-color image than for the monochromatic image even when the recording material is the same. The sampling period of the temperature control is determined in accordance with the combinations of the operation mode selected by the user (color or monochromatic) and the kind of the paper (thick paper, plain paper, thin paper or OHP). As an alternative, detecting means for detecting a thickness of the recording material may be provided, and the sampling period is determined in accordance with the result of the detection.

Then, the temperature of the fixing device is sensed (S03), and on the basis of the result of the sensing, the electric power value Po applied to the induction coil portion 3 is determined (S04). Subsequently, the electric power value Po determined at the step S04 is supplied to the induction coil portion 3.

Then, a detecting operation waits for the time corresponding to the determined sampling period (S06). Then, the discrimination is made as to whether or not the printing operation is to end (S07). If so, the operation branches to the yes-side at step S07, where the electric power application is stopped (S08), and the program ends. If not, the operation branches to the no-side at step S07, where the program operation continues. The foregoing sequence operations are repeated during the operation of the laser beam printer 47, so that temperature of the fixing device 47 is controlled. As described, the heat quantity removed per unit time from the fixing roller is different depending on the kinds of the paper (thick or thin) and on the difference in the amount of the toner between the monochromatic printing and the color printing. In this embodiment using the induction heating type, in order to accommodate these differences, the frequency of the AC current through the induction coil is changed, so that closer electric power control is possible than in the case of a fixing device of a halogen heater type. The lack of uniformity of the surface temperature of the fixing member can be reduced as compared with other types of image fixing systems. Thus, by the appropriate electric power controls matching the respective fixing conditions, the temperature control is precise, so that image quality is improved. The present invention is not limited to the devices described in the foregoing, but is applicable to a system comprising a plurality of machines or a single machine. The above-described functions may be accomplished by a computer (CPU or MPU) of a system or an apparatus which reads software program codes for carrying out the functions to execute the program. The functions may be accomplished by an electric circuit rather than the software. The items of printing conditions and/or the sampling period may be properly selected by one skilled in the art in consideration of the natures of the equipment and/or the required precision and so on. As described in the foregoing, according to the present invention, when the fixing device is in operation, the period or interval of detecting operations of the temperature sensor is changed in accordance with the fixing condition or conditions such as the operation mode (color/monochromatic) the kind of the transfer sheet (thick paper/plain paper/thin paper/QHP or the like), thus enabling a close temperature control matching the fixing condition, so that image forming apparatus capable of forming a high quality image without non-uniformity in the glossiness.

While the invention has been described with reference to the structures disclosed herein, it is not confined to the details set forth and this application is intended to cover such modifications or changes as may come within the purpose of the improvements or the scope of the following claims.

What is claimed is:

1. A fixing apparatus comprising:

a fixing member for fixing with heat an image formed on a recording material;

a temperature sensor for sensing at intervals a temperature of said fixing member; and detection interval changing means for changing the interval of a detecting operation of said temperature sensor, wherein said detection interval changing means changes the interval in accordance with a thickness of the recording material.

2. An apparatus according to claim 1, wherein said detection interval changing means increases the interval with increase of a thickness of the recording material.

3. An apparatus according to claim 1, further comprising a coil for generating a magnetic field, wherein said fixing member generates heat by eddy currents generated by the magnetic field.

4. An apparatus according to claim 1, wherein the image formed on the recording material is an unfixed toner image and the detection interval is longer when the unfixed toner image on the recording material comprises a plurality of colors than when the unfixed toner image is monochromatic.

5. An image forming apparatus comprising unfixed toner image forming means for forming an unfixed toner image on a recording material, and a fixing apparatus as defined in claim 1.

6. A fixing apparatus comprising:

a fixing member for fixing with heat on a recording material an image formed on the recording material;

a temperature sensor for sensing at intervals a temperature of said fixing member; and detection interval changing means for changing the interval of a detection operation of said temperature sensor, wherein said detection interval changing means changes the interval in accordance with a nature of the image on the recording material.

7. An apparatus according to claim 6, wherein said detection interval charging means charges the detection interval to be longer when the unfixed toner image on the recording material comprises a plurality of colors than when the image is monochromatic.

8. An apparatus according to claim 6, further comprising a coil for generating a magnetic field, wherein said fixing member generates heat by eddy currents generated by the magnetic field.

9. An image forming apparatus comprising unfixed toner image forming means for forming an unfixed toner image on a recording material, and a fixing apparatus as defined in claim 6.

* * * * *

UNITED STATES PATENT AND TRADEMARK OFFICE

CERTIFICATE OF CORRECTION

PATENT NO. : 6,834,168 B2
DATED : December 21, 2004
INVENTOR(S) : Shunsaku Kondo It is certified that error appears in the above-identified patent and that said Letters Patent is hereby corrected as shown below:

Title page,
Item [56], References Cited, FOREIGN PATENT DOCUMENTS, “59085516” should read -- 59-85516 --, “09185276” should read -- 9-185276 --, and “2001056621” should read -- 2001-56621 --.

Figures 5, 6:
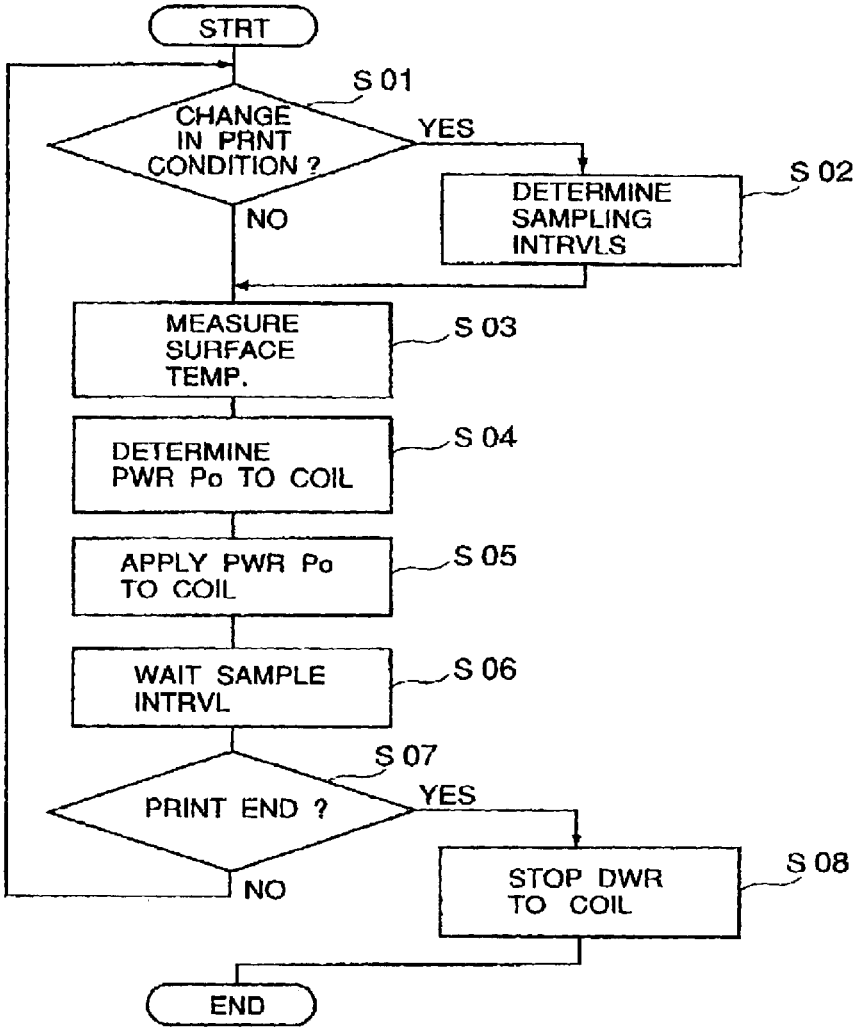
FIG. 5 is a flow chart of a temperature control in the fixing device An according to an embodiment of the present invention.
FIG. 6 is a Table of sampling period or intervals in various printing conditions according to an embodiment of the present invention.

Drawings,
Sheet 3, Figure 5, “PRNT” should read -- PRINT --, and “DWR” should read -- PWR --.

Column 1,
Line 8, “to” should read -- to a --.
Line 47 and 51, “surface layer” should read -- layer --.
Line 54, “lip” should read -- up --.

Column 2,
Line 59, “senior” should read -- sensor --.

Column 3,
Line 34, “to which” should read -- to --.
Line 39, “controls” should read -- control --.
Line 48, “healing” should read -- heating --.

Column 4,
Line 26, “senior” should read -- sensor --.

Column 5,
Line 5, “hearing” should read -- heating --.

Column 6,
Line 7, “winding” should read -- windings --.

Column 7,
Line 28, “capable” should read -- is capable --.

UNITED STATES PATENT AND TRADEMARK OFFICE

CERTIFICATE OF CORRECTION

PATENT NO. : 6,834,168 B2
DATED : December 21, 2004
INVENTOR(S) : Shunsaku Kondo It is certified that error appears in the above-identified patent and that said Letters Patent is hereby corrected as shown below:

Column 8,
Line 29, “charging” should read -- changing --, and “charges” should read -- changes --.

Signed and Sealed this

Seventeenth Day of May, 2005

JON W. DUDAS
*Director of the United States Patent and Trademark Office*